US005619878A

United States Patent [19]

Grosjean et al.

[11] Patent Number: 5,619,878

[45] Date of Patent: Apr. 15, 1997

[54] METHOD AND DEVICE FOR MANUFACTURING A CORRUGATED METAL PIPE

[75] Inventors: François Grosjean, Versailles; Michel Huvey, Bougival, both of France

[73] Assignee: Institut Francais Du Petrole, Rueil Malmaison, France

[21] Appl. No.: 510,162

[22] Filed: Aug. 2, 1995

[30] Foreign Application Priority Data

Aug. 2, 1994 [FR] France ..... 94 09680

[51] Int. Cl.[6] ..... B21D 26/14

[52] U.S. Cl. ..... 72/56; 72/59; 72/62; 72/370

[58] Field of Search ..... 72/54, 59, 61, 72/62, 56, 367, 370

[56] References Cited

U.S. PATENT DOCUMENTS

| | | | |
|---|---|---|---|
| 3,345,732 | 10/1967 | Brower | 72/56 |
| 3,365,522 | 1/1968 | Inoue | 72/56 |
| 3,372,564 | 3/1968 | Crowdes | 72/56 |
| 3,503,246 | 3/1970 | Shiokawa | 72/370 |
| 3,581,456 | 6/1971 | Gere | 72/56 |
| 3,606,780 | 9/1971 | Nagahara | 72/370 |

FOREIGN PATENT DOCUMENTS

| | | | |
|---|---|---|---|
| 2414966 | 9/1979 | France | 72/59 |
| 1696050 | 12/1991 | U.S.S.R. | 72/59 |

*Primary Examiner*—David Jones
*Attorney, Agent, or Firm*—Millen, White, Zelano, & Branigan, P.C.

[57] ABSTRACT

The present invention relates to a method for forming a pipe with a corrugated wall by means of the electroforming technique. The method comprises the stage of forming, possibly partial, on the circumference of the pipe over a length of about one pitch of the corrugation. The corrugated deformation of the pipe is obtained by step-by-step forming after moving the forming mandrel longitudinally in the pipe. The invention also relates to a device for forming a corrugated pipe. In a variant, the device comprises a cylindrical mandrel on which a groove deepens over a circumference portion and continues at the depth of the corrugation to be formed.

5 Claims, 4 Drawing Sheets

METHOD AND DEVICE FOR MANUFACTURING A CORRUGATED METAL PIPE

FIELD OF THE INVENTION

The present invention relates to a method and to the means for implementing the method for manufacturing, by magnetoforming, pipe elements with corrugated walls from metal pipes whose generating lines are substantially rectilinear and parallel to the longitudinal axis. Basic metal pipes are preferably cylindrical.

BACKGROUND OF THE INVENTION

In industry, one often needs to use fluid tight and/or gas tight pipes that also have a certain flexibility. In some cases, tightness problems can be overcome by using pipes made of a supple material, for example plastic, elastomer or equivalent, but very often these materials exhibit a certain gas permeability which may not be acceptable. It is also possible to use sections of a rigid metal pipe connected together by flexible joints. The tightness problem is then transferred to the joints of the connection.

It is possible to use corrugated metal pipes made from metal strips formed by rollers, spirally wound on a mandrel and continuously welded so as to form a tight pipe exhibiting corrugations, and therefore a flexibility increased by the shape of the corrugations. If the weld bead remains tight, the problem of the manufacture of a metal pipe that is notably perfectly gas tight and flexible thanks to the more or less corrugated shape of the generating lines is solved. But this manufacture is slow and requires a rather heavy manufacturing installation, and welding is a technical solution of delicate implementation and control. Furthermore, the bending fatigue strength is often decreased by welding and this manufacturing type only produces good results for certain types of metals.

It is also possible to form, by means of rollers, a cylindrical pipe slipped onto a mandrel of corrugated external shape. However, the drawback of this cold deformation is that is is rather slow and also that is requires relatively big machines, especially when the diameter of the pipe is of the order of about ten centimeters or more. This manufacturing is generally limited to relatively short sections.

The magnetoforming method is already used on elementary parts for performing deformations or joinings through crimping, welding or plating. This method can be performed by compression of the metal or on the contrary by expansion, according to the degree of deformation. But no solution is provided in the case of forming of the surface of a metal pipe that is several meters long.

The magnetoforming process is well known and will not be described here. It will just be reminded that it consists in sending a very short electric impulse in an electromagnetic coil located close to the walls of the part to be formed. The variation in the electromagnetic field produced by the coil generates, in the walls of the conducting metal pipe, an induced current which, by interaction with the current circulating in the coil (Laplace's law), exerts on the walls of the pipe forces equivalent to an electromagnetic pressure, said pressure deforming the pipe by pressing the walls against a forming die.

SUMMARY OF THE INVENTION

The present invention thus relates to a method for forming a metal pipe by electromagnetism. The method comprises the following stages:

a length portion of a metal pipe is placed between means for creating a magnetic field and forming means, the means for creating a magnetic field are activated electrically so as to create an energy that deforms said portion and that presses the walls of said pipe against said forming means, said means for creating a magnetic field and said forming means are moved longitudinally so as to be placed on another, non-deformed length portion of the pipe.

The forming means can be placed inside said pipe portion, said means for creating a magnetic field surrounding the outer surface of the pipe.

The pipe can be deformed with a single activation in the form of a groove or of a circular boss, the deformation width being at most about one pitch.

The pipe can be deformed in the form of a groove or of a boss of helical shape around the axis of the pipe.

The forming means can be moved longitudinally with respect to the pipe through a rotation of said forming means around the axis of the pipe.

A first activation of the means for creating a magnetic field can partly deform the pipe over a circumference portion of the pipe in relation to the desired final deformation, and after moving the forming means through a rotation, a second activation can complete the deformation over at least part of said partly deformed portion.

The metal pipe can comprise at least a pipe made of a material that is not deformable by magnetoforming and a pipe suited for being deformed by magnetoforming, said magnetoforming deformable pipe being interposed between the nondeformable pipe and the means for creating a magnetic field.

The invention also relates to a device for forming a metal pipe by electromagnetism, comprising means for creating an electromagnetic field and forming means. The pipe is placed between the means for creating an electromagnetic field and the forming means, and the device includes means for moving the pipe with respect to the means for creating an electromagnetic field and to the forming means longitudinally along the axis of the pipe so as to deform the pipe stepwise.

The forming means can comprise a mandrel whose outside diameter is slightly smaller than the inside diameter of said pipe, and the mandrel can comprise a groove on its outer surface.

The groove can be helical.

The device can comprise means for moving the pipe longitudinally with respect to the mandrel comprising means for rotating said mandrel with respect to the pipe, and the means for creating an electromagnetic field can comprise means of connection with the mandrel so that their respective positions remain fixed transversely with respect to the pipe.

The depth of the groove can be zero fit its point of origin and deepen substantially regularly over a portion of a helix length shorter than the length corresponding to about a pitch until it reaches the depth corresponding to the constant shape of said groove that continues helically.

On the side of the point of origin of the groove, the cylindrical surface of the mandrel can have a predetermined length so as to properly centre the pipe on the mandrel without jamming the pipe when it is subjected to differential axial deformations resulting from different radial deformation rates.

The end of the mandrel on the origin side of the groove can be beveled or it comprises a great rounding-off radius.

BRIEF DESCRIPTION OF THE DRAWINGS

Other features and advantages of the present invention will be clear from reading the description hereafter given by way of non limitative examples, with reference to the accompanying drawings in which.

DESCRIPTION OF THE PREFERRED EMBODIMENTS

Figure 1:
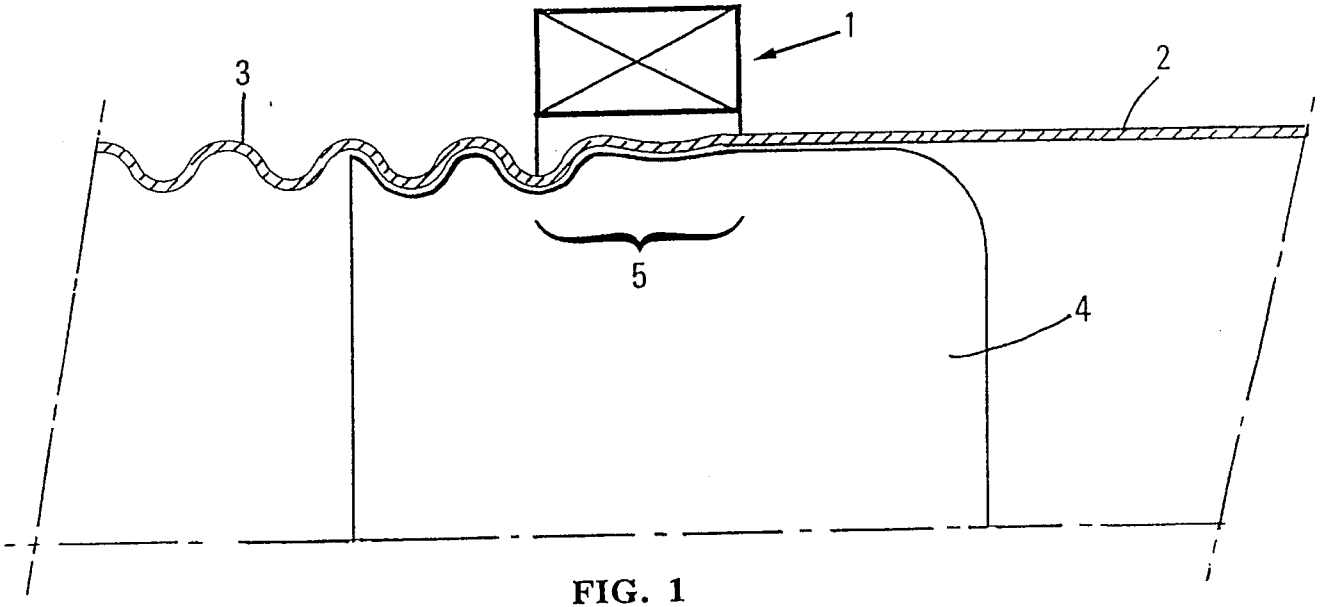
FIG. 1 shows a half section of a pipe during forming.

FIG. 1 schematizes a preferred embodiment of the process and of the device according to the invention. Reference 1 refers to the electromagnetic coil of substantially annular shape placed around a pipe 2 whose part located on the right of the coil is not formed yet, whereas the part of the pipe located on the left of the coil has been formed and comprises corrugations 3. Forming means or mandrel 4 are placed inside the pipe. The shape of mandrel 4 in zone 5 serves as a support and as a die for the deformation of pipe 2 when coil 1 is activated by an electric current.

Several difficulties have to be overcome in order to obtain thereby a corrugated pipe of good quality while providing an economical manufacturing process:

The deformation of the metal in the radial and circumferential direction must be performed preferably by shortening of the pipe rather than by elongation of the metal. In fact, if during the forming operation, the pipe cannot make longitudinal displacements in order to follow the corrugated bending whose trace is longer with respect to the rectilinear generating line of the origin, the metal can be formed in corrugation only with elongations of the material itself. These elongations can form large strictions and sometimes cracks. In such a forming case, the walls will inevitably have zones of reduced thickness which will decrease the mechanical strength of the corrugated pipe.

In the case of forming of a corrugated pipe, if the walls are deformed on several corrugations at the same time, on either side of a top of the corrugation, the longitudinal displacement of the material of the pipe is prevented since, on either side of the top, the material undergoes opposing tensions. The hollow shape between two tops is due to the elongation of the material since the material is pinned between the two tops, which is not the case when a hollow comprises laterally, on at least one side, a cylindrical part.

The present invention therefore advocates a method and a device for avoiding these drawbacks.

In the case of circular corrugations, the width of the coil must be such that the electroforming occurs, at the first electric impulse, only in a single hollow so that the material that forms the hollow can at best result from a displacement of the pipe due to a shortening. After this first deformation, the mandrel and the coil are moved by the length of a hollow so as to form it second hollow following the first one. The deformation of the entire pipe is thus continued stepwise. In the case of a circular corrugation, the mandrel must be designed to be retractable in order to be released from the hollows already formed.

When forming is performed by expansion instead of compression, the drawbacks are obviously comparable and identical solutions can therefore be provided. In this case, the coil is located inside the pipe and the mandrel is outside. With this configuration, it is easier to design a die that opens in at least two parts so as to be released from the formed pipe and to be moved at the level of a non-formed pipe portion.

The present invention preferably aplies to corrugations following from a groove or a boss that is not circular (i.e. annular around the pipe) but helical.

Such a preforming affords two advantages:

As described hereafter, a mandrel interior or exterior to the pipe comprising the form corresponding to the corrugation in the shape of a helical groove can be moved with respect to the pipe by rotation around the axis of the mandrel. In fact, the system can be compared to a screw (mandrel) in a corresponding female part (pipe). A rotation of the screw causes its longitudinal displacement with respect to the female part. The mandrel, be it exterior or interior to the pipe, does not need to be highly retractable or detachable to allow deformations of the pipe through successive activations of the coil.

Figure 2:
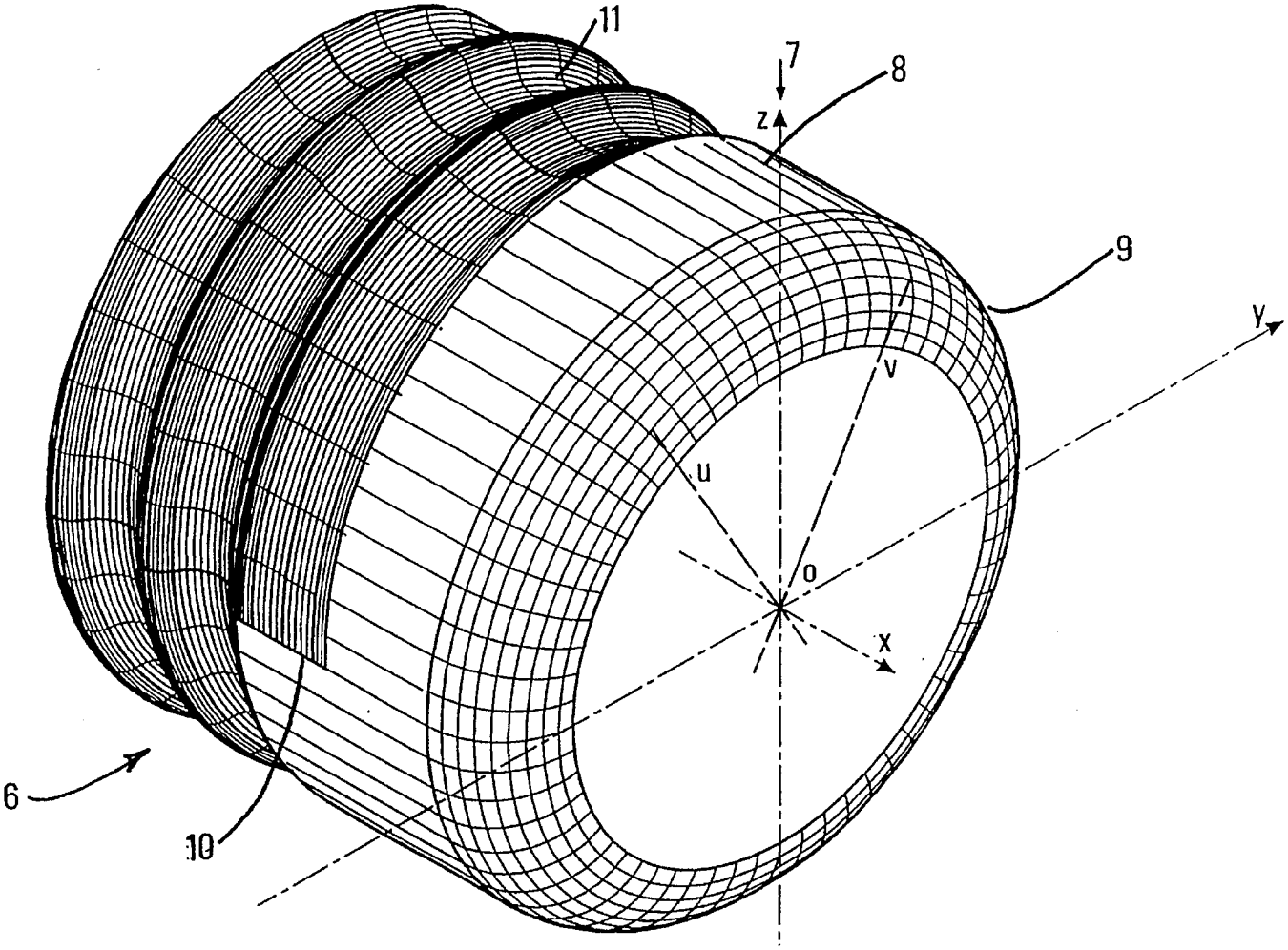
FIG. 2 shows a perspective of the mandrel.
Figure 4:
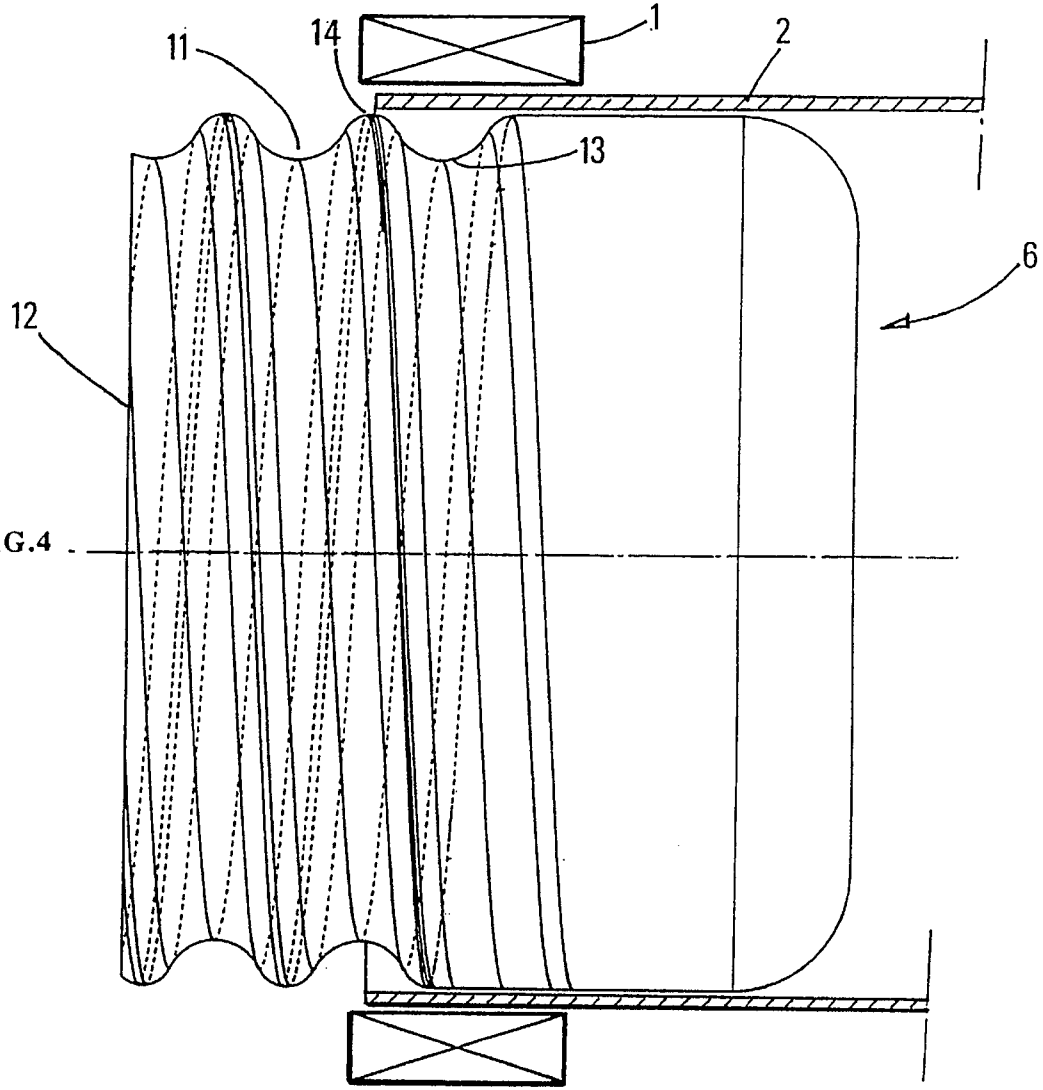
FIG. 4 shows a topview of the mandrel.

FIGS. 2 and 4 illustrate a mandrel 6 shown in perpective in FIG. 2 and in topview in FIG. 4 by means of arrow 7 (FIG. 2). It can be seen that a certain number of lines or dots, helical or longitudinal, have no geometric significance, they result from the CAD drawing mode and have only been kept for reasons of readability of the surfaces and volumes.

A trihedron Ox,y,z marks the mandrel 6 of axis Ox. Mandrel 6 comprises a cylindrical part 8 whose diameter is close to the inside diameter of pipe 2 (FIG. 1). The groove 11 with line 10 as the origin comprises slightly more than two spiral pitches on the mandrel. The end of the cylindrical part 8 is machined in the form of a rounding-off 9 so that this part, which enters the pipe that is not formed yet, is in contact with the inner surface of the pipe by providing as little friction as possible. In fact, part 8 serves as an axial guidance for the pipe on the mandrel and vice versa, but the pipe shortens substantially as a result of the radial deformations provided by the electromagnetic field of the coil. Such a shortening can be assumed not to be uniformly regular on the circumference if the radial deformation rate is distributed differently on the circumference. The pipe can then shorten while moving slightly off-centre. The rounded shape 9 of cylinder 8 can limit the possible stickings of the pipe on the mandrel when the pipe moves off-centre.

Figure 3:
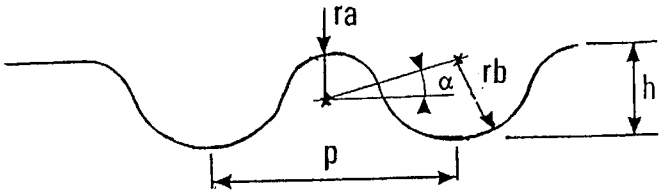
FIG. 3 shows a schematic example of the dimensions of a corrugation.

FIG. 3 shows an example of a corrugation trace defined by a pitch p=37.2 mm, a height h of the corrugation h=11.8 mm, the hollow having a radius rb=13 mm, the top having a radius ra=7.5 mm, the junction between the hollows and the tops being tangential, the orthogonal line at the tangent of the two circles of radius ra and rb forming an angle of 25° to the axis of the pipe.

Such a corrugation example has been so determined that the deformation rate would theoratically be 25% if the pipe did not shorten.

Of course, the present invention is not limited to this profile, equivalent profiles for other corrugated pipes can be obtained with the method and with the device described here.

FIG. 4 is a topview of the mandrel 6 along arrow 7 (FIG. 2), i.e. the corrugated contours shown in FIG. 4 are those of the intersection of the plane Oxy with the mandrel. Line 11 is the point of origin of the helical groove that completes here slightly more than two pitches before it enters the zone 12 of the mandrel. Line 13, diametrically opposite the point of origin 11 of the groove, represents the shape of the groove as it continues helically up to 12. At 11, it can be noticed that the groove bottom is cylindrical. The groove is regularly deeper over the half circumference contained between 11 and 13. Then, from 13 on, the groove has a constant profile up to the end of the mandrel. In FIG. 4, pipe 2, which is not formed, is shown positioned up to the point of the mandrel bearing reference number 14. Coil 1 surrounds the end of pipe 2.

Figure 6:
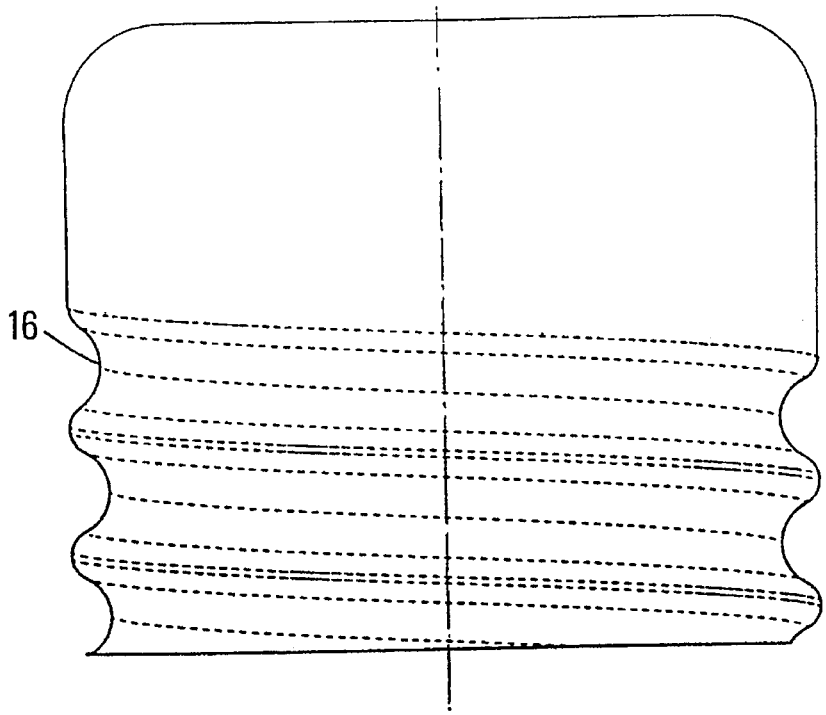
FIGS. 5 and 6 show a cross-section of the mandrel along two different planes.
Figure 5:
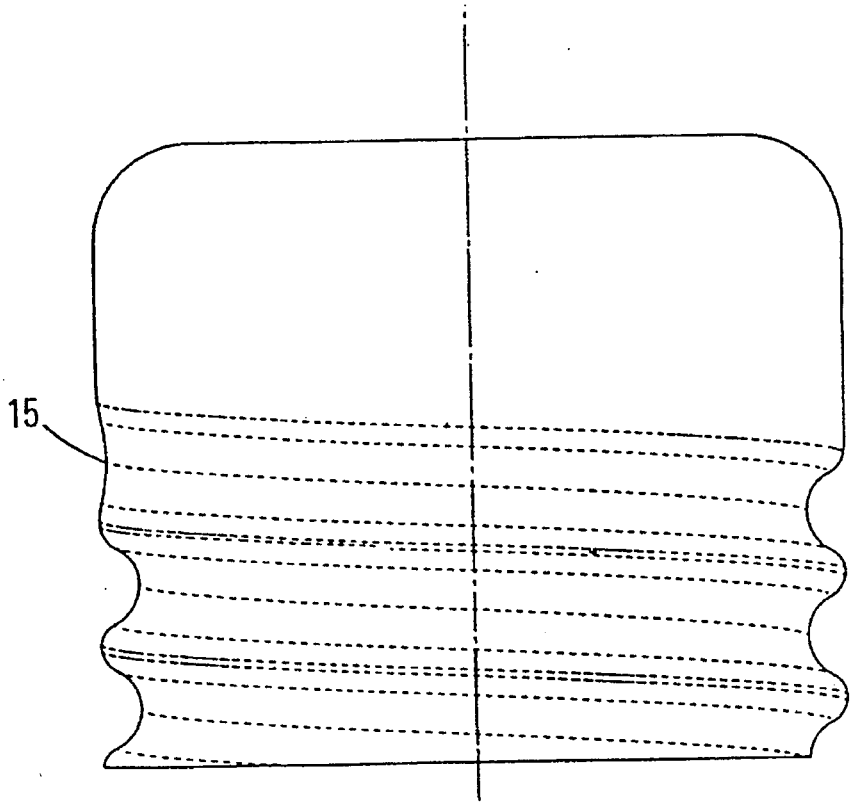

FIGS. 5 and 6 represent the sections of the mandrel along the planes Oxu and Oxv shown in FIG. 2. FIG. 5 shows the section of the mandrel along the plane Oxu inclined at 60° to the plane Oxy. Line 15 shows the profile of the groove in this plane, which is rather shallow. FIG. 6 shows the section of the mandrel along the plane Oxv inclined at 60° to the plane Oxu. Line 16 shows the profile of the groove in this plane, which is less deep than the final profile, but still rather close thereto. It can be noted that the profiles diametrically opposite the groove of increasing depth are connected on the right to a cylindrical part of the mandrel. This form is advantageous because it promotes the shortening of the pipe. This function is explained in detail hereafter.

Operations:

FIG. 4 shows the first stage of electromagnetic forming on a pipe 2 that is entirely cylindrical. The pipe is set and brought into position by conventional means. Coil 1 and mandrel 6 are connected together for example by a frame and a pin that bears the mandrel, said pin having a certain length which allows the penetration or the removal of the mandrel from the pipe as the forming operation continues and the coil is thus fastened to the mandrel so that it remains in the same radial plane.

Pipe 2 brought to the point 14 of the mandrel covers several zones, starting from the right of the mandrel: a cylindrical part, a half pitch of the groove of increasing depth on a half turn, a certain groove portion having the final profile. At the first "firing" or activation of the coil, pipe 2 is pressed against the mandrel and takes its shape, i.e.: a groove of variable depth and a groove of final profile. This first firing poses no problem of material elongation since no previous deformation prevents the possibility of a longitudinal displacement of the pipe, be it towards the right or the left with reference to FIG. 4.

After this first firing, the mandrel can be moved with respect to the pipe only by rotation, in the direction of the thread represented by the initial part of the groove. By rotating the mandrel anticlockwise here since the helix is on the right, while preventing the rotation of the pipe around its axis, the mandrel is driven back towards the right by a distance that is directly related to the angle of rotation and to the pitch of the helix. For example, a half turn rotation causes the mandrel to move back half a pitch. It can be assumed that, in the example shown in FIG. 4, the mandrel is unscrewed in the pipe by a half turn from the right. As a result, the previously partly formed part will be opposite a part of the groove of final profile, a cylindrical part of the pipe will be opposite the groove of increasing depth and the part of the pipe formed according to the groove of final profile is shifted in a groove portion of equal profile on the mandrel. This latter part also serves as a guidance for screwing the mandrel in the pipe.

At the second firing, only two modes of deformation occur: the cylindrical part of the pipe located opposite the groove of increasing depth warps partly and the previously partly deformed part of the pipe takes the final form of the groove opposite which it is located after the second firing.

The deformation of the pipe is continued by repeating this second stage.

As described above, one of the objects of the invention is to prevent the longitudinal displacements of the pipe from being blocked, so that there is no or little material elongation as a result of the forming operation and that forming is performed by material displacement and by shortening of the pipe. It can be observed that, at the time of the second firing (and of the following ones also), the pipe is cylindrical on the right of each formed part, which allows the pipe to take the corresponding shapes of the mandrel, preferably by displacement rather than by elongation. In order to abide by this condition, the second stage prior to the second firing (and the following stages) must theoretically take place with a rotation of the mandrel at most equal to an angle of 360°–i, i being the angle corresponding to the length of the groove of increasing depth. The optimization of the invention can focus on the adaptation of said angle i, of the shape of the groove and of the part of increasing depth, of the angle of rotation of the mandrel in order to obtain notably:

the fastest manufacturing process possible, a minimal friction between the mandrel and the formed pipe, a forming with the lowest possible decrease in thickness of the pipe.

The adaptation must also take account of the geometry of the pipe and of the material that it is made of.

In order to facilitate the displacement of the pipe by screwing of the mandrel, lubricating products or equivalent products can be inserted between the pipe and the mandrel prior to the firing. These products can be injected into the annular space by means of ports opening into the bottom of the groove of the mandrel.

The invention is not limited to the example described above, other applications can be implemented. In particular, the method of forming by electromagnetism may not apply to a pipe made from a material that is a bad conductor. In this case, it will be possible to interpose a good conductor pipe between the poor electricity conductor pipe and the coil, so that the deformation of the first-mentioned pipe, referred to as a propulsive pipe in the profession, leads to the deformation of the poor or non conductor pipe.

The corrugated pipe portions manufactured in the limit of the penetration of the mandrel in the pipe can be welded together so as to form a continuous pipe of greater length.

We claim:

1. A method of forming a metal pipe by electromagnetism, comprising the following stages:

placing a length portion of a metal pipe having an outer surface and an inner surface around an undeformable rigid form having a helical shape, activating a magnetic field located at a position surrounding the outer surface of the pipe proximate the portion of metal pipe and undeformable rigid form to deform said portion and press said portion against said undeformable rigid form to create an initial groove of increasing depth to a final profile, the groove being the length of one pitch thereof, moving the undeformable rigid form longitudinally with respect to the metal pipe to be placed at another, non-deformed length portion of the pipe by rotating the undeformable rigid form one pitch, and after moving the undeformable rigid form through a rotation to advance the pipe one pitch, again activating the magnetic field to create a second deformation in the pipe which completes the deformation over at least part of said initial groove to form a complete groove of the final profile.

2. A method as claimed in claim 1, characterized in that said metal pipe comprises at least a pipe made of a material that is not deformable by magnetoforming and a pipe suited for being deformed by magnetoforming, said deformable pipe being interposed between the non-deformable pipe and the magnetic field.

3. A device for forming a metal pipe having an outside diameter and inside diameter about a longitudinal axis thereof by electromagnetism, comprising: an electromagnet and an undeformable rigid helical form, the rigid helical form comprising a mandrel having an outside diameter slightly smaller than the inside diameter of said pipe, having a depth of zero at its point of origin and deepening substantially regularly over a portion of a helix length that is shorter than a length corresponding to substantially a length of about a single pitch until the groove reaches a depth corresponding to a constant shape of said groove as the groove continues helically, the mandrel having helical groove on an outer surface thereof wherein the pipe is placed between the electromagnet and undeformable rigid helical form to form an initial groove portion having a depth which increases from zero to a constant depth, and further including means for moving longitudinally the pipe with respect to the electromagnet and undeformable rigid helical form by rotating the mandrel with respect to the longitudinal axis of the pipe to advance the form about one pitch and to magnetically deform the pipe stepwise, the electromagnet including means for connecting with the mandrel so that the respective positions of the electromagnet and mandrel remain fixed transversely with respect to the pipe.

4. A device as claimed in claim 3, characterized in that on a side of the point of origin of the groove, the cylindrical surface of the mandrel has a predetermined length so as to properly center the pipe on the mandrel without jamming the pipe when the pipe is subjected to differential axial deformations resulting from radial deformation rates.

5. A device as claimed in claim 4, characterized in that an end of the mandrel on the origin side of the groove is beveled or comprises a large rounding-off radius.

* * * * *